United States Patent [19]

Kondo

[11] 4,204,439

[45] May 27, 1980

[54] HEAD FOR A POWER OPERATED SCREWDRIVER

[75] Inventor: Hiroo Kondo, Maizuru, Japan

[73] Assignee: Nitto Seiko Co., Ltd., Kyoto, Japan

[21] Appl. No.: 971,417

[22] Filed: Dec. 20, 1978

[30] Foreign Application Priority Data

Dec. 28, 1977 [JP] Japan ..... 52-178492

[51] Int. Cl.[2] ..... B25B 23/02

[52] U.S. Cl. ..... 81/57.37

[58] Field of Search ..... 81/57.37; 144/32; 29/813

[56] References Cited

U.S. PATENT DOCUMENTS

| | | | |
|---|---|---|---|
| 2,534,140 | 12/1950 | Moore | 144/32 |
| 3,294,130 | 12/1966 | Dörrer | 144/32 |
| 3,547,169 | 12/1970 | Bangerter | 144/32 |
| 4,003,417 | 1/1977 | Cornwall | 144/32 |

*Primary Examiner*—James L. Jones, Jr.

*Attorney, Agent, or Firm*—Armstrong, Nikaido, Marmelstein & Kubovcik

[57] ABSTRACT

A power operated screwdriver having a head at an end thereof. The head includes a body having a bit passageway and a screw passageway. The bit and screw passageways intersect in an inclined manner. A pair of screw holding jaws are pivotally mounted in a detachable manner on the head. A spring is provided for each of the screw holding jaws for biasing the screw holding jaws towards one another for holding screws in a driving position after the screws exit from the screw passageway. Stop jaw mounting openings are provided at an end of each of the holding jaws and pass completely through the holding jaws. A pair of stop jaws are pivotally mounted in a detachable manner within each of the mounting openings. A spring is provided for each of the stop jaws for biasing the stop jaws towards one another. Both the holding jaws and the stop jaws pivotally swing in the same plane.

13 Claims, 12 Drawing Figures

HEAD FOR A POWER OPERATED SCREWDRIVER

BACKGROUND OF THE INVENTION

1. Field of the Invention

This invention relates to an improvement in the head part of a power operated screw driver, and more particularly, to a head having holding jaws for holding screws, sent one by one through a pipe and having stop jaws for preventing the return of the screws.

2. Description of the Prior Art

In the past, for example, in the U.S. Pat. No. 3,247,874, two holding jaws were provided freely pivoted across the end of a head part in such a manner that they approached each other, and one stop jaw was provided freely pivoted at right angles to the pivoting directions of the holding jaws. Therefore, with such a construction, however, it is impossible to drive screws into parts having restricted widths or into deep recesses. Another disadvantage of such a construction is the lack of screw stability because a screw head being held by the holding jaws is retained at one position by one stop jaw.

Japanese Utility Model Journal Publication No. 44-18318 discloses a screwdriver in which stop jaws are built in to pivot inside each of a pair of opposing holding jaws and springs are attached to the backs of the stop jaws so that the stop jaws are biased to approach each other. This mechanism has solved the drawbacks discussed above with regard to U.S. Pat. No. 3,247,874. However, since the stop jaws are built in, the width of the holding jaws in the pivoting direction was increased. That is, the presence of leaf springs at the back of stop jaws and the wall thickness of the holding jaws proper contributes to a corresponding increase in the width of the holding jaws. Further, since the two holding jaws are set across the tube which guides the bit, the width of the entire head is widened at least twice as large as the increment. This causes an extremely important problem considering that this kind of screwdriver is often used in restricted areas and that even a slight increase in the head part width may greatly confine the application range. Additionally, in the event of replacement of the stop jaws or spring when the screw head shape is changed or if the spring for the stop jaw is broken, the replacement work takes a great deal of time and is very complicated because the entire holding jaw must be disassembled. Another problem is the risk of screwdriver destruction by continuing a screwing operation after breakage of the stop jaw spring, since such breakage is not visible from the outside.

SUMMARY OF THE INVENTION

It is an object of the present invention to provide a screwdriver having narrow width screw holding jaws.

Another object of the invention is to provide a screwdriver having easily replaceable screw stop jaws.

A further object of the invention is to provide a screwdriver which permits immediate visual observance of stop jaw operating spring breakage.

These objects are attained in the present invention by providing a head for an end of a power operated screwdriver. The head includes a body having a bit passageway and a screw passageway. The bit and screw passageways intersect in an inclined manner. A pair of screw holding jaws are pivotally mounted in a detachable manner on the head. A spring is provided for each of the screw holding jaws for biasing the screw holding jaws towards one another for holding screws in a driving position after the screws exit from the screw passageways. Stop jaw mounting openings are provided at an end of each of the holding jaws and pass completely through the holding jaws. A pair of stop jaws are pivotally mounted in a detachable manner within each of the mounting openings. A spring is provided for each of the stop jaws for biasing the stop jaws towards one another. Both the holding jaws and the stop jaws pivotally swing in the same plane.

BRIEF DESCRIPTION OF THE DRAWING

These and other objects and advantages of the invention will become more fully apparent as the following description is read in conjunction with the attached drawings wherein.

DETAILED DESCRIPTION OF THE PREFERRED EMBODIMENTS

Figure 1:
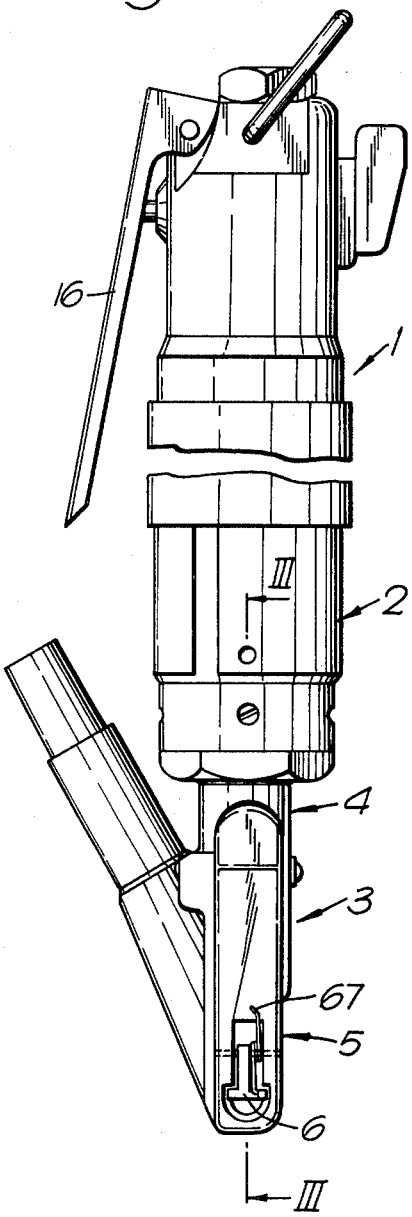
FIG. 1 is a partially omitted front elevational view showing a preferred embodiment of the invention.
Figure 2:
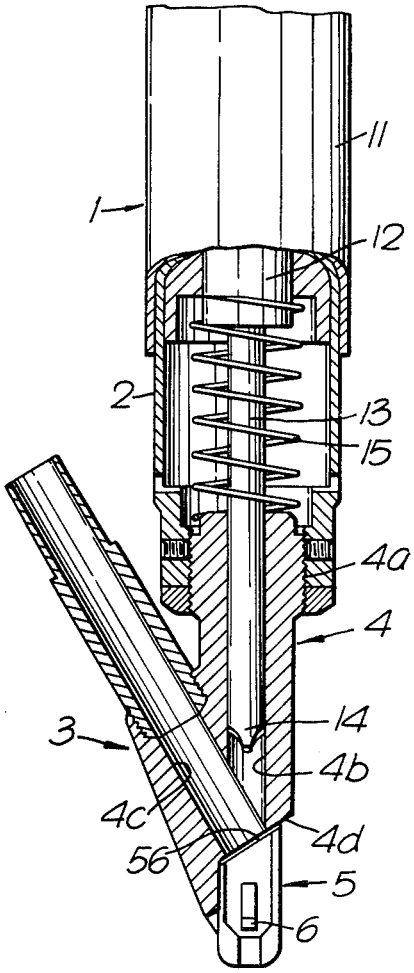
FIG. 2 is a partially cut-away longitudinal sectional view of FIG. 1.
Figure 11:
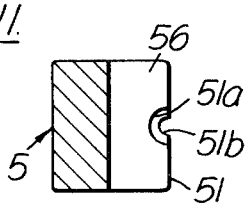
FIGS. 11 and 12 are cross-sectional views taken along the line XI—XI and XII—XII of FIG. 5, respectively.
Figure 12:
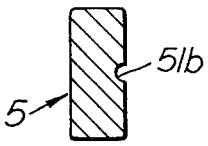

Referring now to FIGS. 1 and 2, the screwdriver is comprised of a driver body 1, a drive shaft 12 in driving connection with a bit rod 13 having a screw bit 14 formed at an end opposite the drive shaft 12, and a holder 11 incorporating a drive source (not shown) such as an electric or air motor to rotate it. A telescoping linkage sleeve 2 is positioned inside the holder 11. A head 3 is threadedly connected to an end of the telescoping linkage sleeve 2. A compression coil spring 15 is positioned between a bearing of the drive shaft 12 and the head 3 inside the holder 11, thereby holding the body 1 apart from the head 3. The drive source is controlled by a trigger 16 in any known manner.

The head 3 includes a body 4 having passageways for guiding screws. Holding jaws 5 are fitted to the body 4 at an end of passageways and accommodate screws admitted from a screw passageway **4*c* and hold the screws in a driving position concentrically with a bit passageway 4*b*. Stop jaws 6 are pivotally attached to the holding jaws 5** and prevent the screws from returning into the body when the screws are pressed into contact with a workpiece while being held in the holding jaws.

The body 4 includes a threaded end **4*a* which is threadedly received by cooperating threads formed on the interior of the telescoping linkage sleeve end 2**. An end of the screw passageway 4c obliquely intersects with the bit passageway 4b.

Two holding jaws 5 are pivotally mounted across the end of the body 4 in a manner to permit free swinging towards and away from each other. The holding jaws 5 like a bar include a screw guide 51, a body support 52 and a lever arm 53. The holding jaws 5 are pivotally mounted on the body 4 by a pin 54 which penetrates the boundary between the body support 52 and the lever 53. A compression coil spring 55 is positioned between a spring seat 53a provided in an end of the lever 53 opposite the screw guide end 51 and the body 4. The spring 55 causes the two holding jaws 5 and accordingly, the screw guides 51, to be biased towards each other.

The screw guides 51 are positioned at the tip of the bit passageway 4b. The screw guides 51 are comprised of a first cylindrical guide wall 51a and a second cylindrical guide wall 51b. The first cylindrical guide wall 51a becomes substantially flush with the bit passageway 4b in concentricity when the two screw guides 51, 51 are closest to each other, while the second cylindrical guide wall 51b grabs the screw neck at its end.

Each screw guide 51 is provided with a stop jaw mounting hole 51c which penetrates through the first cylindrical guide wall 51a to its opposite side wall; that is, from the inside of holding jaws 5 through the rear side. The tip side wall and the end side wall of holding jaws 5 in mounting hold 51c, respectively, correspond to contact face 51d and mounting face 51e of the stop jaws 6, and both faces are inclined in the lengthwise direction of first cylindrical guide wall 51a so as to approach the tip as going from the outside to the inside of the holding jaws 5.

The stop jaws 6 are pivoted freely in the stop jaw mounting opening 51c on a pin 66 which passes through the stop jaws. The pivoting plane of the stop jaws 6 is substantially the same as the pivoting plane of the holding jaws 5. Each of the stop jaws 6 includes a lever 61, a cam 62 provided at the end of lever 61, and a contact part 63. The side of cam 62 adjoining lever 61 forms a spring seat 64. A mounting hole 65 in lever 61 is adapted to receive the pivot pin 66. A torsion coil spring 67 is mounted on the pin 66. One end of the coil spring 67 is supported by a mounting face 51e formed in the mounting hole 51c, while the other end is supported by the spring seat 64 on the stop jaw 6. This configuration causes the spring 67 to bias the stop jaws 6, 6 towards each other.

Figure 3:
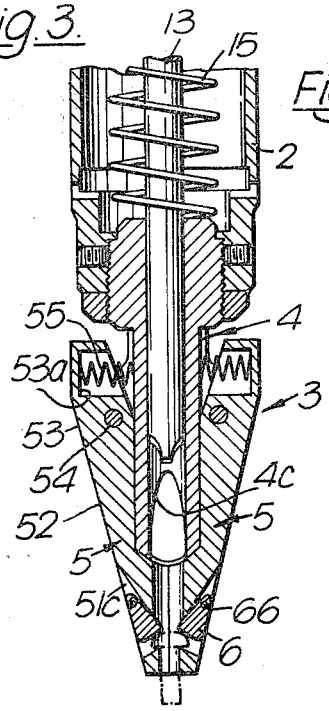
FIG. 3 is a cross-sectional view taken along the line III—III of FIG. 1.
Figure 4:
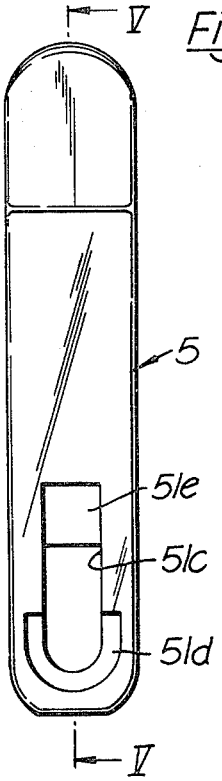
FIG. 4 is an enlarged view of a portion of FIG. 1.
Figure 5:
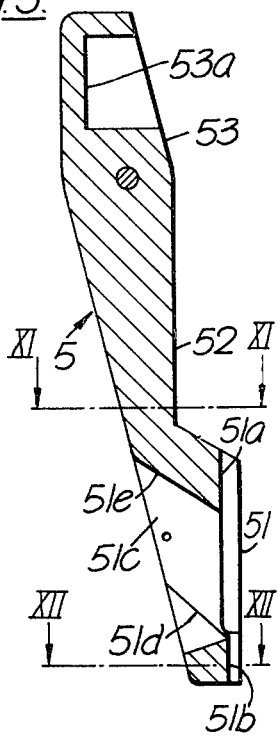
FIG. 5 is a cross-sectional view taken along the line V—V of FIG. 4.
Figure 6:
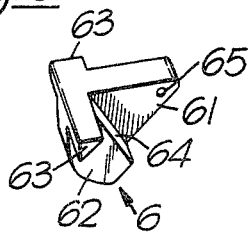
FIG. 6 is an enlarged perspective view of a stop jaw.
Figure 7:
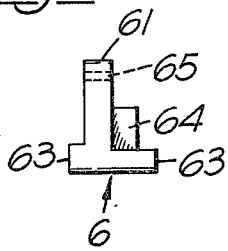
FIG. 7 is a front elevational view of the stop jaw illustrated in FIG. 6.
Figure 8:
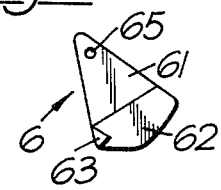
FIG. 8 is a side elevational view of the stop jaw illustrated in FIG. 6.

The operation of the above described mechanism will now be explained. Compressed air supplied from a feeder unit (not shown) causes a screw to project from the screw passageway 4c of head 3 into the area enclosed by the first cylindrical guide walls 51a of the holding jaws 5. The screw further hits against cams 62,62 of the stop jaws 6 to expand their clearance and pass through. Thereafter, the screw is grabbed by the second cylindrical guide walls 51b of the holding jaws 5. In this state, the stop jaws 6 contact the rear of the screw head to block retraction of the screw back into the screw passageway 4c, thereby completing preparation for the driving operation, as seen in FIG. 3.

Thus, in this invention, since the stop jaw mounting openings 51c penetrate through the holding jaws 5 and the stop jaws 6 are freely pivoted in these holes or openings, the width of the holding jaws can be designed narrow enough only to mount the stop jaws. It is not necessary to remove the holding jaws 5 when replacing the stop jaws 6 or the spring 67 if broken, thus providing a tool which can be efficiently and quickly repaired. Further, since damage or breakage can be easily visually checked, additional trouble with the rest of the mechanism can be prevented.

Also, the end face 4d, to which bit passageway 4b at the tip of body 4 opens, is designed to have a plane at approximately right angles to the lengthwise direction of the screw passageway 4c at the intersection of the bit passageway 4b with the screw passageway 4c. Accordingly, the screw guide 51 of holding jaw 5 approaches face to face with end face 4d. The screw guide also includes a stepped part 56 which is inclined in the lengthwise direction at the boundary to body support 52 so that the first cylindrical guide wall 51a will be approximately continuous with the bit passageway 4b and the screw passageway 4c. In this manner, a screw introduced from the screw passageway 4c collides against the first cylindrical guide wall 51a of holding jaw 5 without hitting the inner wall of the bit passageway 4b, and reaches the second cylindrical guide wall 51b. Therefore, if the first cylindrical guide wall 51a is damaged or worn by continued collision with screws, only the holding jaws 5 need be replaced, without having to replace the entire head 3. Hence, repair of the tool is very economical. Additionally, since the first cylindrical guide wall 51a for guiding the screws is fitted to the holding jaw 5 itself, it is not necessary, unlike in the prior art configurations, to extend a tube body for the bit passageway up to the vicinity of the top of the head 3. Therefore, the width of the head in the present invention is reduced at least by a portion corresponding to the double of the wall thickness of the tube body.

In the above description, contact part 63 of stop jaw 6 is positioned at right angles to the lengthwise direction of lever 61, but it may alternatively be provided along the lengthwise direction, in which case, therefore, the receiving face of contact part 63 should be situated in the holding jaw 5.

Figure 9:
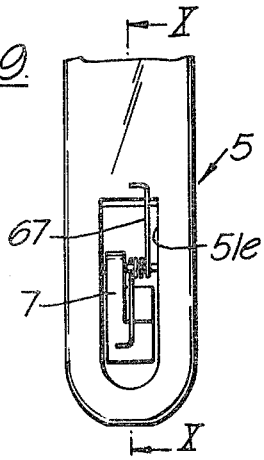
FIG. 9 is a partial front elevational view showing another embodiment of a stop jaw and its mounting position.
Figure 10:
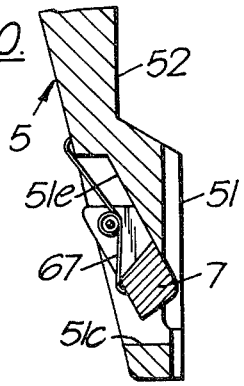
FIG. 10 is a cross-sectional view taken along the line X—X of FIG. 9.

In another alternative embodiment, the contact part 63 may be omitted, a side of stop jaw 7 being configured to contact with the mounting face of holding jaw mounting hole 51c, as shown in FIGS. 9 and 10.

Stop jaw mounting face 51e may, alternatively, not be inclined and, instead, may be formed parallel to the lengthwise direction of the first cylindrical guide wall 51a. By providing this mounting face 51e, the positioning will be easy when mounting the stop jaw 6.

Referring further to FIG. 3, it will be observed that the shape and size of stop jaw 6 and mounting hole 51c are determined to permit the stop jaw 6 to sink into the mounting opening 51c whenever a screw is not passing through the stop jaws 6. Therefore, stop jaw 6 will not project from the back of holding jaw 5, so that the total width of head 3 is reduced and collision of the stop jaw 6 with other objects and corresponding breakage, is prevented. Similarly, the stop jaw 6 may also be designed to permit the stop jaws 6 to sink into hole 51c while a screw passes. The shape and size of the stop jaw 6 and mounting opening 51c may be otherwise variably changed, and in a certain case, stop jaw 6 may project somewhat outwardly from the mounting hole 51c. For example, in FIGS. 1 through 8, stop jaw 6 projects outwardly from the mounting opening 51c when a screw passes.

The head 3 may contain a sleeve 2 which is integrally constructed therewith.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

I claim:

1. A screwdriver having a head at an end thereof, the head comprising:

a body;

a bit passageway formed in said body;

a screw passageway intersecting with said bit passageway in an inclined manner;

a pair of screw holding jaws pivotally mounted across an end of said body;

spring means for biasing said holding jaws towards one another for holding screws admitted from said screw passageway in a driving position;

stop jaw mounting openings provided at an end of each of said holding jaws penetrating from the inside to the back side thereof;

stop jaws freely pivoted in each of said mounting holes in the same plane as the pivoting plane of the holding jaws; and spring means for biasing said stop jaw towards one another.

2. A screwdriver as claimed in claim 1, wherein said holding jaws include a screw guide, said screw guide being aligned with a tip of said bit passageway; said screw guide including a first cylindrical guide wall which becomes substantially flush with said bit passageway when said two screw guides are closest to each other; said stop jaw mounting hole penetrating from said first cylindrical guide wall to the back side of said holding jaws.

3. A screwdriver as claimed in claim 2, wherein an end surface to which said bit passageway at the tip of said body opens being designed to have a plane at approximately right angles to the lengthwise direction of said screw passageway at the intersection of said bit passageway and said screw passageway, said screw guides of said holding jaws approaching face to face with an end face of said body and possessing a stepped part which is inclined in the lengthwise direction of said holding jaws such that said first cylindrical guide wall is approximately continuous with said bit passageway.

4. A screwdriver as claimed in claim 2, wherein a tip side wall and an end side wall of said holding jaws in said mounting hole respectively correspond to a contact face and a mounting face of said stop jaws, both said faces being inclined in the lengthwise direction of said first cylindrical guide wall so as to approach said tip as going from the outside to the inside of said holding jaws, said stop jaws being freely pivoted on a pin which passes through said stop jaws, said stop jaws having a lever and a cam which is provided at its end and contact part.

5. A screwdriver as claimed in claim 1, wherein said stop jaw and said stop jaw mounting hole are shaped and sized, to permit said stop jaw to completely fit within the periphery of said mounting hole in said holding jaw whenever a screw is not passing through said stop jaws.

6. A screwdriver as claimed in claim 1, wherein said stop jaw and said stop jaw mounting hole are shaped and sized to permit said stop jaw to project from said mounting hole whenever a screw is not passing through said stop jaw.

7. A screwdriver as claimed in claim 1, wherein said stop jaw and said stop jaw mounting hole are shaped and sized to permit said stop jaw to completely fit within the periphery of said mounting hole in said holding jaw while a screw is passing through said stop jaws.

8. A screw driver as claimed in claim 1, wherein said stop jaw and said stop jaw mounting hole are shaped and sized to permit said stop jaw to project from said mounting hole in said holding jaw while a screw is passing through said stop jaws.

9. A screwdriver as claimed in claim 4, wherein the side of cam adjoining lever forming a spring seat, the spring means for the stop jaws being a torsion spring mounted on the pin, one end of said coil spring being supported by the mounting face while the other end being supported by the spring seat on the stop jaws.

10. A screwdriver as claimed in claim 9, wherein the contact part of stop jaw being positioned at right angles to the lengthwise direction of the lever.

11. A screwdriver as claimed in claim 9, wherein the contact part of stop jaw being positioned along the lengthwise direction.

12. A screwdriver as claimed in claim 2, wherein an end side wall of the holding jaws in said mounting hole correspond to a mounting face of said stop jaws, said stop jaws being freely pivoted on a pin which passes through said stop jaws, said stop jaws having a lever and a cam which is provided at its end.

13. A screwdriver as claimed in claim 12, wherein the side of cam adjoining lever forming a spring seat, the spring means for the stop jaws being a torsion spring mounted on the pin, one end of said coil spring being supported by the mounting face while the other end being supported by the spring seat on the stop jaws.

* * * * *